United States Patent [19]

Ando et al.

[11] 4,227,435

[45] Oct. 14, 1980

[54] ELECTRONIC MUSICAL INSTRUMENT

[75] Inventors: Shigeo Ando, Iwata; Takayasu Kondou, Hamamatsu, both of Japan

[73] Assignee: Nippon Gakki Seizo Kabushiki Kaisha, Hamamatsu, Japan

[21] Appl. No.: 898,523

[22] Filed: Apr. 20, 1978

[30] Foreign Application Priority Data

Apr. 28, 1977 [JP] Japan ..... 52-48412
May 9, 1977 [JP] Japan ..... 52-51970

[51] Int. Cl.[3] ..... G10H 1/02

[52] U.S. Cl. ..... 84/1.19; 84/1.24; 84/1.21; 84/1.22; 84/1.26

[58] Field of Search ..... 84/1.01, 1.03, 1.24, 84/1.26, 1.27, 1.19, 1.21, 1.22

[56] References Cited

U.S. PATENT DOCUMENTS

| | | | |
|---|---|---|---|
| 3,443,463 | 5/1969 | Campbell | 84/1.01 |
| 3,467,759 | 9/1969 | Campbell | 84/1.25 |
| 3,836,693 | 9/1974 | Ichikawa | 84/1.19 |
| 3,902,396 | 9/1975 | Hiyoshi | 84/1.24 |
| 3,935,783 | 2/1976 | Machanian | 84/1.26 |
| 3,981,217 | 9/1976 | Oya | 84/1.01 |
| 3,992,970 | 11/1976 | Chibana | 84/1.03 |
| 3,999,458 | 12/1976 | Suzuki | 84/1.01 |
| 4,077,294 | 3/1978 | Hiyoshi | 84/1.24 |
| 4,082,027 | 4/1978 | Hiyoshi | 84/1.01 |
| 4,117,759 | 10/1978 | Kato | 84/1.24 |
| 4,138,915 | 2/1979 | Nagai | 84/1.01 |

FOREIGN PATENT DOCUMENTS

| | | |
|---|---|---|
| 1935306 | 9/1975 | Fed. Rep. of Germany . |
| 2302214 | 8/1976 | Fed. Rep. of Germany . |

*Primary Examiner*—J. V. Truhe
*Assistant Examiner*—William L. Feeney
*Attorney, Agent, or Firm*—Cushman, Darby & Cushman

[57] ABSTRACT

A musical tone varying in tone color with the lapse of time is produced in an electronic musical instrument by retrieving a plurality of different waveshapes from a plurality of memories and then by mixing these retrieved waveshapes at a variable ratio according to a plurality of time-dependent parameters. In order to ensure a simpler arrangement of the instrument while maintaining richness in tone color variation characteristics of the produced musical tone, the mixing is adapted to be performed by carrying out multiplications individually on the respective retrieved waveshapes with the associated time-dependent parameters and then by adding up the resultant values to obtain the aimed musical tone. Some of the time-dependent parameters may be derived from other time-dependent parameter in the mixing procedure of several different waveshapes.

6 Claims, 11 Drawing Figures

ELECTRONIC MUSICAL INSTRUMENT

BACKGROUND OF THE INVENTION (a) Field of the Invention

The present invention relates to an electronic musical instrument, and more particularly it pertains to an electronic musical instrument of the waveshape memory type wherein waveshapes are successively read out from the memories and then converted to musical tones.

(b) Description of the Prior Art

In conventional electronic musical instruments of the so-called waveshape memory type, a certain waveshape is previously stored in a storage means and is repetitively read out, in response to key depression, at a rate associated with the depressed key to produce a corresponding musical tone.

A typical example of overall arrangement of such a conventional electronic musical instrument is shown in block in FIG. 1. In this Figure, a keyboard circuit 2 is provided for selecting a musical tone to be produced in response to the operation of the keyboard arrangement (not shown) of the instrument. When a key in the keyboard arrangement is depressed, the keyboard circuit 2 generates the logical "1" signal only on an output line assigned to the depressed key to instruct the selected key number to a frequency information memory 4. Also, a key-on signal KON is delivered from the keyboard circuit 2 upon depression of any one of keys and is kept generated as long as the key is kept depressed. The keyboard circuit 2 is further equipped with means for selecting one key, in preference to others, among a plurality of keys depressed at a time and thus specifying a single key to be evaluated. As such preference key selection means, there may be employed such circuits as those disclosed in U.S. Pat. No. 3,981,217 issued on Sept. 21, 1976 and assigned to the same assignee as the present application.

Output lines of the keyboard circuit 2 are fed to the address input of the frequency information memory 4 in which is stored the frequency information corresponding to each key. Thus, when a key is selected and depressed, the frequency information memory 4 is accessed with an address given by the output line of the keyboard circuit 2, and a frequency information corresponding to the selected key is read out from the memory 4. The read-out frequency information is successively added to the content of the cumulative adder 6 at each arrival of a clock pulse $\phi$ in the adder with a modulus. The temporary content of the adder 6 is successively transferred to the address input of a waveshape memory 10. In the waveshape memory 10, there has been previously stored a waveshape in a digital representation, for instance. More particularly, the amplitudes for a plurality of sample points of a composite waveshape including a fundamental component as well as many harmonic components are stored in individual address locations of the memory 10. Accordingly, the waveshape memory 10 is repetitively accessed with the contents of the adder 6, i.e. the addresses and the amplitudes of the stored waveshape are successively read out. As will be seen from the previous explanation, the incrementing or decrementing rate of content of the adder 6 is dependent upon a particular key depressed. As a result, there will be obtained from the waveshape memory 10 a waveshape at a repetition period, i.e. a fundamental frequency corresponding to the depressed key.

An envelope generator 15 and a multiplier 12 are provided for imparting a required envelope characteristic to the waveshape generated from the waveshape memory 10. The envelope generator 15 is designed to operate so that when initiated by the key-on signal KON, it generates an envelope waveshape. The envelope waveshape may be classified roughly into two types: a percussive waveshape as shown in FIG. 2A and a sustained waveshape as illustrated in FIG. 2B. The envelope generator is preferably designed so that either one of these two types of envelope waveshapes can be selected by means of a musical tone selection switch on the panel board of the instrument.

The waveshape which is read out from the waveshape memory 10 is fed to the multiplier 12 and multiplied with the envelope waveshape generated by the envelope generator 15 in the multiplier. Thus, envelope-imparted waveshape is obtained in the multiplier 12, which, in turn, is inputted to a sound system 14 to be converted into a musical tone. The sound system 14 essentially consists of an audio amplifier and a loud speaker, and may also include a digital-analog converter if the waveshape in the memory 10 is in a digital representation.

As explained above, with the conventional musical instrument, it is possible to obtain a musical tone which is provided with an amplitude transient characteristic, i.e. an envelope characteristic. However, the musical tone produced by the conventional instrument remains unchanged in tone color during the entire period of the generation thereof, because a single kind of waveshape retrieved from the waveshape memory is used for the generation of the musical tone. In contrast thereto, a sound pronounced by a natural musical instrument is such that its tone color, i.e. the frequency spectrum of the sound, will continuously change during the generation with the lapse of time. Accordingly, the musical tone produced by the conventional instrument is liable to lack richness in tone color and to be just monotonous.

SUMMARY OF THE INVENTION

It is, therefore, a primary object of the present invention to provide an electronic musical instrument in which the afore-mentioned shortcomings encountered in such conventional instrument as described previously and which is capable of producing a musical tone having richness in tone color comparable to that of a sound of a natural musical instrument.

Another object of the present invention is to provide an electronic musical instrument of the type described, which is able to generate an impressive and pleasant musical tone imparted with a tone color varying with the lapse of time like the sounds of a natural musical instrument.

In an attempt to meet these objectives, there has been proposed in U.S. patent application Ser. No. 773,788 filed on Mar. 2, 1977, by the same assignee as that of the present application, now U.S. Pat. No. 4,138,915, an electronic musical instrument wherein a plurality of different waveshapes are retrieved from a plurality of waveshape storage means and then mixed together at a variable ratio according to a time-dependent parameter, the mixed waveshape being used to produce a musical tone whose tone color will vary with the time lapse. However, this priorly proposed instrument is yet accompanied by some problems concerning the system for variably mixing the different waveshapes, for the following reasons. Namely, in this instrument, the waveshapes are mixed in such a manner that some waveshapes read out from one group of the waveshape memories are multiplied (or logarithmically added) with a time-dependent parameter while the other waveshapes retrieved from another group of the waveshape memories are divided (or logarithmically subtracted) by the same parameter, and then both results are added together. It will be recognized, therefore, that at the time when the parameter varies around an indefinitely small value, the waveshape components obtained by said division not only will attain an extremely large value but also will exhibit sharp and abrupt changes in intensity with respect to a very little variation of the parameter. This, in turn, will tend to develop unnatural sharp changes in amplitude as well as in tone color of the musical sound produced, particularly at the attack or rise period of the musical tone.

It is, accordingly, a further object of the present invention to provide an electronic musical instrument of the type described previously, which employs an improved system for mixing a plurality of different waveshapes at a mixing ratio varying in accordance with lapse of time.

According to one aspect of the present invention, there is provided an electronic musical instrument comprising: a plurality of memories storing different waveshapes and accessible in response to the selection of a key of the keyboard arrangement; means for generating a plurality of different time-dependent parameters; means for mixing the waveshapes which are read out from the memories at a variable ratio according to time-dependent parameters, by performing the multiplications on the individual read-out waveshapes with associated time-dependent parameters and then adding up the resultant values of the multiplications; and means for converting a waveshape received from the mixing means into a musical sound.

These and other objects, features as well as the advantages of the present invention will become apparent from the following detailed description of the preferred embodiments when taken in conjunction with the accompanying drawings.

DETAILED DESCRIPTION OF THE PREFERRED EMBODIMENTS

Figure 1:
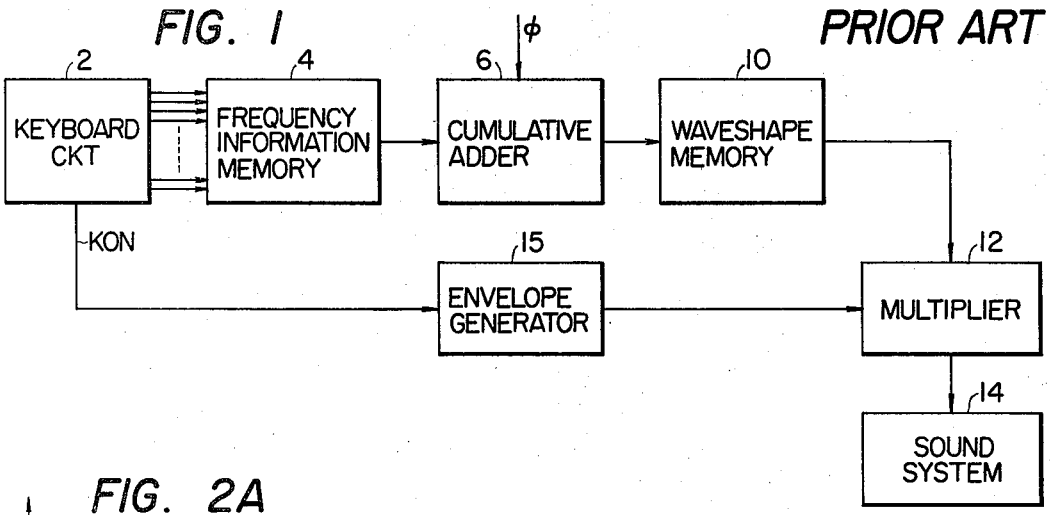
FIG. 1 PRIOR ART
FIG. 1 is a block diagram showing a conventional musical instrument of the waveshape memory type.
Figure 2A:
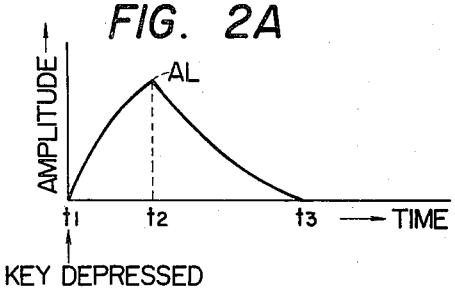
FIGS. 2A and 2B are charts illustrating typical examples of envelope waveshapes, respectively.
Figure 2B:
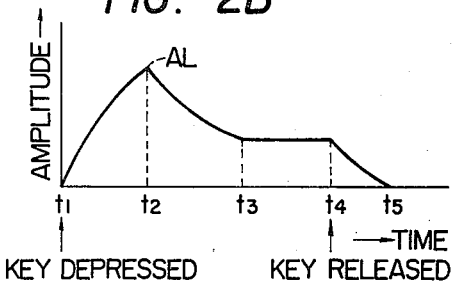
Figure 3:
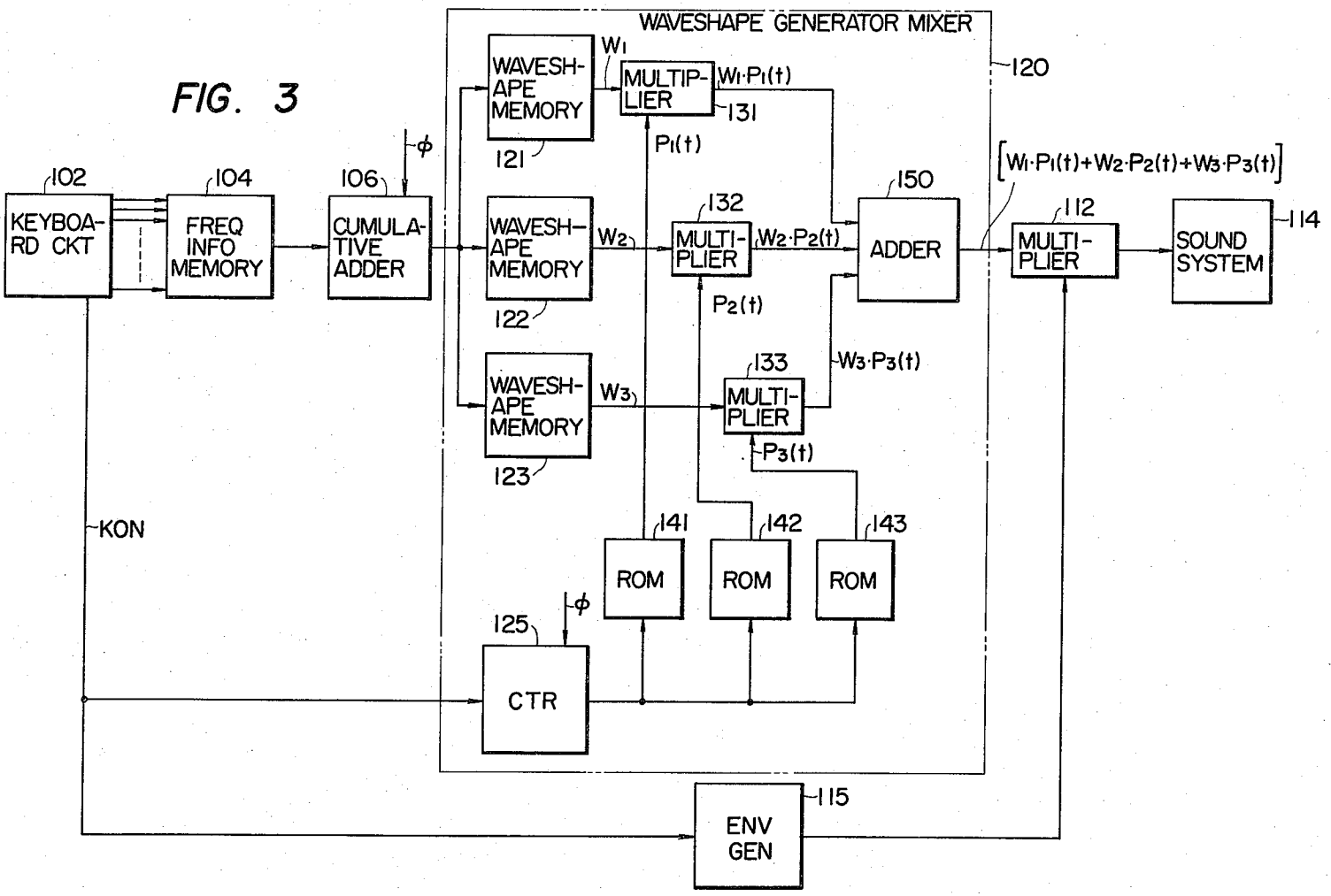
FIG. 3 is a block diagram showing an example of arrangement of an electronic musical instrument according to the present invention.

In FIG. 3 is illustrated in block diagram an example of an electronic musical instrument embodying the present invention, which has a basic structure similar to that of FIG. 1 excepting that the waveshape memory 10 in FIG. 1 is replaced by a waveshape generator mixer 120. Namely, when a key in a keyboard arrangement (not shown) is depressed and selected in a keyboard circuit 102, a frequency information memory 104 is accessed with an address supplied from the keyboard circuit 102 and a frequency information corresponding to the depressed key is retrieved from the memory 104 to be fed to a cumulative adder 106. The retrieved frequency information is cumulatively added at each arrival of a clock pulse $\phi$ in adder 106. The waveshape generator mixer 120 is designed to operate so that when it is actuated by a key-on signal KON from the keyboard circuit 102 and supplied with the contents of the cumulative adder 106, it will generate a composite waveshape of a plurality of different waveshapes mixed together at a ratio varying with lapse of time. That is, a waveshape varying in tone color with time and having a fundamental frequency corresponding to the depressed key is delivered out from the waveshape generator mixer 120. With the key-on signal KON, an envelope generator 115 is initiated to generate an envelope waveshape which is such a function of time as that shown in FIG. 2A or 2B. In a multiplier 112, the output waveshape of the waveshape generator mixer 120 and the envelope waveshape from the envelope generator 115 are multiplied with each other and the resultant value is then converted to a musical tone by a sound system 114.

The waveshape generator mixer 120 includes three waveshape memories 121, 122 and 123 in which are stored in advance different waveshapes, respectively. For example, the waveshape memory 121 is storing a pure sinusoidal waveshape $W_1$ containing no higher harmonic components; the waveshape memory 122 is storing heavily-deformed sinusoidal waveshape $W_2$ with a large amount of higher harmonic components included; and the waveshape memory 123 is storing a fairly-deformed sinusoidal waveshape $W_3$ containing a fairly little amount of higher harmonic components, respectively, as shown as the amplitude versus address in FIGS. 4A, 4B and 4C, respectively. As a key is depressed, the respective waveshape memories 121, 122 and 123 are successively addressed with the content of the cumulative adder 106 in synchronism with the timing of the clock pulse $\phi$, and the different waveshapes $W_1$, $W_2$ and $W_3$ are read out from these memories to be fed to respective multipliers 131, 132 and 133 provided in the waveshape generator mixer 120. In these multipliers 131, 132 and 133 are carried out multiplications on the retrieved waveshapes $W_1$, $W_2$ and $W_3$ with different time-dependent parameters $P_1(t)$, $P_2(t)$ and $P_3(t)$, respectively. Then the resultant values of the multiplications, i.e. the three different waveshape components which are amplitude-modulated with the associated three time-dependent parameters are algebraically added at an adder 150 in the waveshape generator mixer 120.

Figure 5:
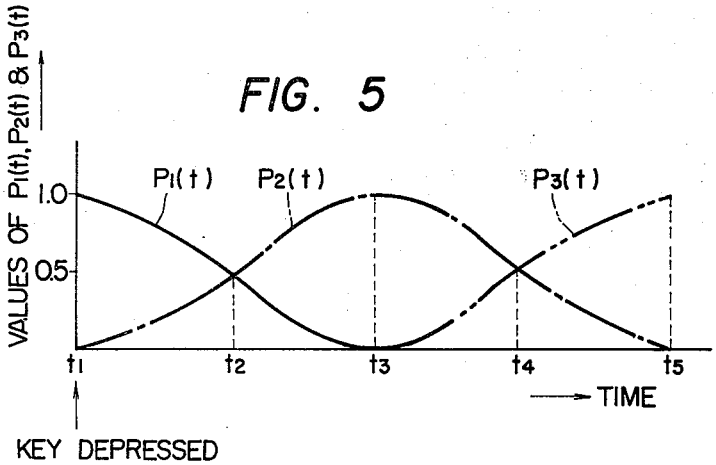
FIG. 5 is a chart showing an example of the set of time-dependent parameters generated from a parameter generator employed in FIG. 3.

As such, in the waveshape generator mixer 120, the three different waveshapes $W_1$, $W_2$ and $W_3$ are mixed together at a variable mixing ratio determined in accordance with the time-dependent parameters $P_1(t)$, $P_2(t)$ and $P_3(t)$, with the result that there can be sounded from the sound system 114 a musical tone varying in tone color with respect to lapse of time. More particularly, if the respective time-dependent parameters $P_1(t)$, $P_2(t)$ and $P_3(t)$ are set at such functions of time as those shown in FIG. 5, then there is obtained a tone-color variation characteristic of the produced musical tone as follows. At the time $t_1$ when a key is depressed, $P_1(t)=1$, $P_2(t)=0$, and $P_3(t)=0$, hence the output of the waveshape generator mixer 120 contains only the component of the waveshape $W_1$, so that a pure musical tone without harmonic components is produced. At the time $t_2$ when the envelope waveshape shown in FIG. 2A or 2B attains a highest value AL, and when the produced musical tone reaches a peak intensity, there is outputted from the waveshape generator mixer 120 a composite waveshape of two waveshapes $W_1$ and $W_2$ mixed together at a ratio of 1:1, so that a musical tone containing a relatively large amount of higher harmonic components is produced from the sound system 114. At the time $t_3$ corresponding to that of FIGS. 2A and 2B, the parameter $P_1(t)$ decreases to zero while the parameter $P_2(t)$ increases up to one (unity). Accordingly, only the component of the waveshape $W_2$ is delivered from the waveshape generator mixer 120, and thus a very colorful tone containing a large amount of higher harmonic components is produced. Thereafter, the parameter $P_2(t)$ gradually becomes smaller with time, whereas the parameter $P_3(t)$ gradually increases. At the time $t_5$, the parameter $P_2(t)$ diminishes to zero while the parameter $P_3(t)$ reaches one (unity), and then only the component of the waveshape $W_3$ is delivered from the waveshape generator mixer 120, with the result that there is produced a relatively pure tone containing a relatively small amount of higher harmonic components.

As stated above, it is possible to produce a pleasant natural musical tone whose tone color varies with time throughout the entire period of the generation in a manner similar to that of a tone produced by a natural musical instrument. It should be noted, here, that the manner in which the tone color of the musical tone produced changes with time lapse can be arbitrarily determined simply by properly selecting the types of waveshapes to be stored in the waveshape memories 121, 122 and 123 and/or the parameters $P_1(t)$, $P_2(t)$ and $P_3(t)$.

Referring again to FIG. 3, means for generating such time-dependent parameters $P_1(t)$, $P_2(t)$ and $P_3(t)$ is provided in the waveshape generator mixer 120, which includes a counter 125, and three read-only memories 141, 142 and 143 for instance. In the respective memories 141, 142 and 143 are stored three sets of information associated with those parameters, respectively. The counter 125 is cleared and initiated with the key-on signal KON to begin counting up of the clock pulse $\phi$. The individual memories 141, 142 and 143 are successively accessed with the addresses designated by the contents of the counter 125, thus delivering out the time-dependent parameters $P_1(t)$, $P_2(t)$ and $P_3(t)$. Needless to say, the above-mentioned means for parameter generation may be comprised of a known function generator circuit.

Figure 4A:
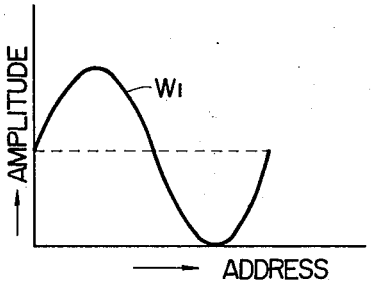
FIGS. 4A, 4B and 4C are charts illustrating an example of the set of waveshapes stored in respective waveshape memories in FIG. 3.
Figure 4B:
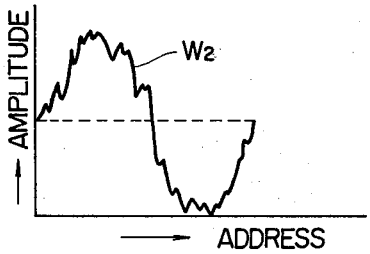
Figure 4C:
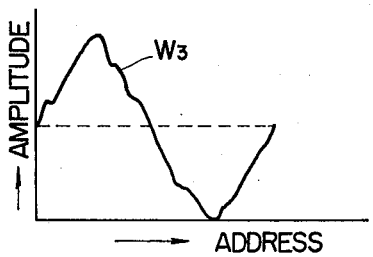
Figure 6:
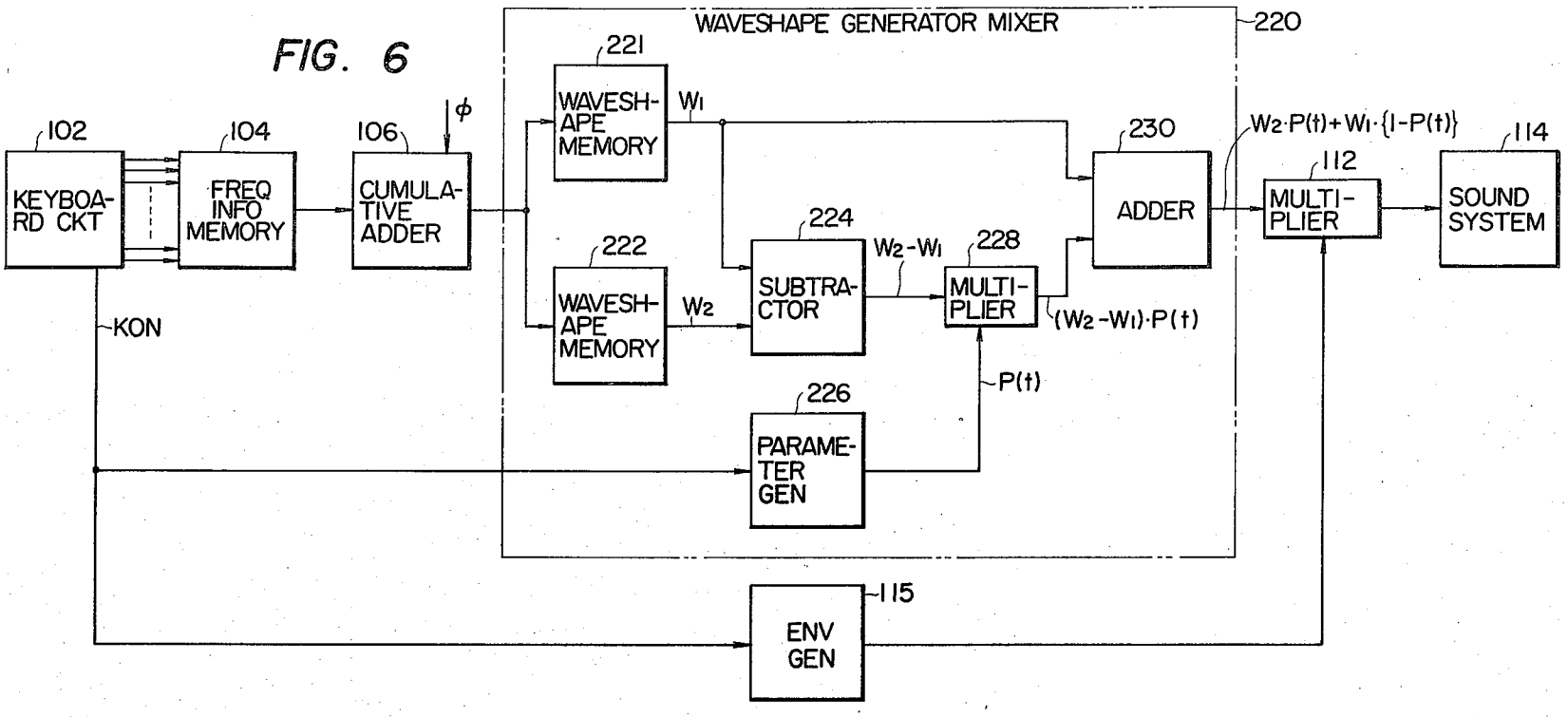
FIG. 6 is a block diagram showing another example of an electronic musical instrument according to the present invention.

Another embodiment of the present invention is described with reference made to FIG. 6, which is different from the previously-mentioned embodiment only in the arrangement of the waveshape generator mixer. The waveshape generator mixer 220 of this instant embodiment includes two waveshape memories 221 and 222. In the respective waveshape memories 221 and 222 are stored different waveshapes $W_1$ and $W_2$ such as shown in FIGS. 4A and 4B, respectively. The waveshape generator mixer 220 further includes a subtracter 224, an adder 230, a parameter generator 226 and a multiplier 228 for mixing the two waveshapes retrieved from the waveshape memories 221 and 222 at a variable mixing ratio in accordance with both a time-dependent parameter P(t) generated by the parameter generator 226 and a derivative time-dependent parameter $P(t)'=1-P(t)$, which is derived through mathematical operations performed by the subtracter 224, the multiplier 228 and the adder 230, as will be explained below.

When the key is depressed, the waveshapes $W_1$ and $W_2$ are repetitively read out from the waveshape memories 221 and 222 at a repetition rate corresponding to the tone pitch assigned to the depressed key. The retrieved waveshape $W_1$ is fed to one input of the adder 230 and also to one input of the subtracter 224, while the retrieved waveshape $W_2$ is fed to another input of the subtracter 224, the output of this subtracter 224 being applied to one input of the multiplier 228. This multiplier 228 has another input applied with a time-dependent parameter P(t) given from the parameter generator 226, and an output thereof is fed to another input of the adder 230. Therefore, the difference $W_2-W_1$ between the two waveshapes is obtained in the subtracter 224, and then it is multiplied with the applied time-dependent parameter P(t) in the multiplier 228. The resulting product $(W_2-W_1)\cdot P(t)$, in turn, is added with the waveshape $W_1$ in the adder 230, so that there is obtained a composite waveshape $W_2\cdot P(t)+W_1\cdot\{1-P(t)\}$ at the output of this adder 230.

As will be easily recognized from the composite waveshape form thus obtained, a new time-dependent parameter $P(t)'=1-P(t)$ is derived in the circuit network of the subtracter 224, the multiplier 228 and the adder 230, based on the single time-dependent parameter P(t) generated from the parameter generator 226. Furthermore, the multiplication on the waveshape $W_1$ with the derivative time-dependent parameter P(t)' is equivalently accomplished without provision of any multiplier exclusively for this multiplication. As such, according to the arrangement of this embodiment, it is possible to simplify the arrangement of the parameter generating menas.

Figure 7A:
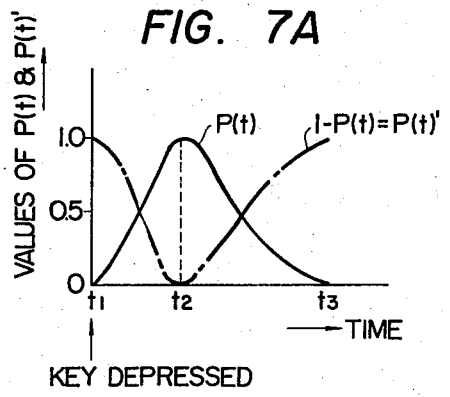
FIGS. 7A and 7B are charts illustrating different examples of a time-dependent parameter generated from a parameter generator employed in FIG. 6.
Figure 7B:
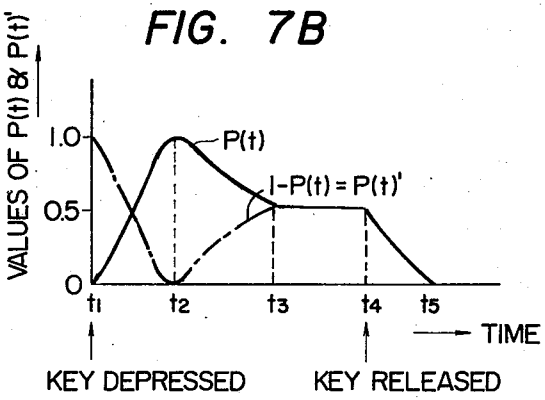

The parameter generator 226 may be composed, in a manner similar to that in the previous embodiment in FIG. 3, of a read-only memory storing a required information for the generation of the above-mentioned parameter P(t) and also of a counter for addressing this read-only memory, or of a known function generator circuit. Typical waveshapes of the time-dependent parameter P(t) are shown in FIGS. 7A and 7B. In these Figures, the corresponding derivative parameters P(t)' are represented by dotted lines. The waveshape of the time-dependent parameter P(t) shown in FIG. 7A is generally effective to use when a percussive tone is selected to be produced from the musical instrument, i.e. when such an envelope waveshape as shown in FIG. 2A is generated from the envelope generator 115. On the other hand, the waveshape of the time-dependent parameter P(t) illustrated in FIG. 7B is effectively applicable when a sustaining tone is required to be produced from the instrument, i.e. when such an envelope waveshape as shown in FIG. 2B is selected.

As have been described above, in the electronic musical instrument according to the present invention, the variable mixing of a plurality of different waveshapes retrieved from plural waveshape memories is performed in accordance with an arithmetic procedure including no divisional operation and the resultant tone signal comprises components of the respective waveshapes which are linear functions of the respective time-dependent parameters. Therefore, the instrument of the present invention is inherently free from such a problem as might be encountered in the instrument proposed in U.S. patent application Ser. No. 773,788. Namely, even though any one of the time-dependent parameters employed for the control of the mixing ratio of plural different waveshapes assumes an indefinitely small value, the mixed waveshape will not exhibit any undesirable sharp change in amplitude as well as in tone color. This musical instrument of the present invention, accordingly, is capable of smoothly controlling, in a required manner, the tone color of the musical tone produced, without the need of provision of any such particular means for compensating for the unnatural tone color changes as would be required in the musical instrument disclosed in said U.S. Application. Particularly, in case the respective time-dependent parameters are determined so that the total value of them all always remains constant as in the case of FIGS. 5 and 7, the amplitude of the composite waveshape of plural different waveshapes mixed together will not change irrespective of the tone color. Therefore, means for controlling the envelope of the produced musical tone, i.e. the envelope generator, can be much simplified. As such, according to the present invention, there can be provided an improved electronic musical instrument which is capable of producing a musical tone that is natural and pleasant to the listener, and which is simple in construction.

What is claimed is:

1. An electronic musical instrument of a waveshape memory type, comprising:

a plurality of waveshape memories for storing different waveshapes which are identical in fundamental wave but different in harmonic components;

tone-identifying means for giving access to said waveshape memories to reproduce different waveshape signals;

mixing means for mixing these different waveshape signals together respective mixing coefficients determined by time-dependent parameter generating means, and for generating a resulting composite waveshape signal consisting of signal components each representing each of said different waveshapes and being in a linear relationship with each of said mixing coefficients which are respectively such functions of time that the total sum of all of such functions is alsways held constant, at least one of said mixing coefficients being multiplied by at least one of said different waveshape signals;

means for imparting an amplitude envelope to said composite waveshape signal for time-dependent controlling of tone amplitude; and means for converting said composite waveshape signal into a corresponding musical tone, thereby attaining separate time-dependent controlling of tone color and of tone amplitude.

2. An electronic musical instrument of a waveshape memory type, comprising:

a plurality of waveshape memories for storing different waveshapes which are identical in fundamental wave but different in harmonic components;

tone-identifying means for giving access to said waveshape memories to reproduce different waveshape signals;

mixing means for mixing these waveshape signals delivered from said plurality of waveshape memories, which mixing means comprising:

means for generating at least one time-dependent parameter, arithmetic means for achieving multiplication on said waveshape signals with said time-dependent parameter or parameters, and means for generating a composite waveshape signal in accordance with an output of said arithmetic means so that the composite waveshape signal comprises said different waveshape signals having respective mixing coefficients determined by said means for generating at least one time-dependent parameter, each of said mixing coefficients being such a function of time that the total sum of all of such functions is always held constant, at least one of said mixing coefficients being multiplied by at least one of said different waveshape signals;

means for imparting an amplitude envelope to said composite waveshape signal for time-dependent controlling of tone amplitude; and means for converting a resulting envelope-imparted composite waveshape signal into a corresponding musical tone, thereby attaining separate time-dependent controlling of tone color and of tone amplitude.

3. An electronic musical instrument of a waveshape memory type according to claim 2, in which:

said mixing means includes a plurality of multipliers associated with said means for generating at least one time-dependent parameter for multiplying said different waveshape signals with said time-dependent parameters, and an adder for adding up the resulting products delivered from said multipliers to thereby produce said composite waveshape signal.

4. An electronic musical instrument of a waveshape memory type according to claim 2, in which:

said means for generating at least one parameter includes a counter for counting a timing pulse in response to an operation of said tone identifying means, and a plurality of memories storing information associated with said time-dependent parameters and accessible with the content of said counter for generating said time-dependent parameters.

5. An electronic musical instrument of a waveshape memory type according to claim 4, in which:

said tone identifying means includes means for supplying information representative of a pitch of said musical tone to be produced by said musical instrument, and a cumulative adder for cumulatively adding up said information at each arrival of a timing pulse; and in which:

said waveshape memories are repetitively accessible with addresses designated by contents of said cumulative adder to produce therefrom said different waveshape signals.

6. An electronic musical instrument of a waveshape memory type according to claim 2, including:

a subtracter for carrying out subtraction on two said different waveshape signals;

a multiplier for multiplying a result of this subtraction by said time-dependent parameter supplied from said means for generating at least one time-dependent parameter; and an adder for adding up a product of this multiplication with one of said two different waveshape signals evaluated in said subtracter to thereby deliver said composite waveshape signal.

* * * * *